US006827573B2

(12) United States Patent
St. Charles et al.

(10) Patent No.: US 6,827,573 B2
(45) Date of Patent: Dec. 7, 2004

(54) GAS MICRO BURNER

(75) Inventors: Frank Kelley St. Charles, Perry, GA (US); Kayyani C. Adiga, Macon, GA (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 10/217,695

(22) Filed: Oct. 25, 2002

(65) Prior Publication Data

US 2004/0081933 A1 Apr. 29, 2004

(51) Int. Cl.[7] ..... F23D 14/62; F23D 14/14
(52) U.S. Cl. ..... 431/329; 431/344; 431/354
(58) Field of Search ..... 431/354, 355, 431/268, 326, 328, 329, 344

(56) References Cited

U.S. PATENT DOCUMENTS

| | | | | | |
|---|---|---|---|---|---|
| 1,800,334 | A | | 4/1931 | Aronson | |
| 1,818,783 | A | * | 8/1931 | Beam | 431/353 |
| 1,874,970 | A | * | 8/1932 | Hall | 239/403 |
| 2,088,985 | A | * | 8/1937 | Widegren | 431/268 |
| 2,110,062 | A | * | 3/1938 | Gibson | 431/268 |
| 2,243,924 | A | * | 6/1941 | Schmitt et al. | 431/268 |
| 2,505,047 | A | | 4/1950 | Horning | |
| 3,125,153 | A | * | 3/1964 | Lindgren | 431/344 |
| 3,768,962 | A | * | 10/1973 | Baranowski, Jr. | 431/353 |
| 3,844,707 | A | | 10/1974 | Wormser | |
| 3,912,443 | A | * | 10/1975 | Ravault et al. | 431/328 |
| 3,915,623 | A | | 10/1975 | Wormser | |
| 4,003,694 | A | | 1/1977 | Lowell | |
| 4,076,014 | A | | 2/1978 | Wiquel | |
| 4,207,055 | A | | 6/1980 | Tanaka | |
| 4,235,588 | A | | 11/1980 | Tanaka | |
| 4,235,589 | A | * | 11/1980 | Vallera | 431/344 |
| 4,416,613 | A | * | 11/1983 | Barisoff | 431/243 |
| 4,531,906 | A | | 7/1985 | Mizukami | |
| 4,565,521 | A | * | 1/1986 | Hancock | 431/75 |
| 4,596,525 | A | | 6/1986 | Hsu | |
| 4,634,374 | A | | 1/1987 | Herko | |
| 4,640,679 | A | | 2/1987 | Perrin | |
| 4,643,667 | A | * | 2/1987 | Fleming | 431/7 |
| 4,653,999 | A | | 3/1987 | Dennis, Jr. et al. | |
| 4,850,854 | A | | 7/1989 | Buck | |
| 4,929,174 | A | | 5/1990 | Wang | |
| 5,044,933 | A | | 9/1991 | Yang | |
| 5,161,964 | A | | 11/1992 | Frigiere et al. | |
| 5,292,244 | A | * | 3/1994 | Xiong | 431/189 |
| 5,346,392 | A | | 9/1994 | Kim | |
| 5,716,204 | A | * | 2/1998 | Mifune et al. | 431/344 |
| 6,536,442 | B2 | * | 3/2003 | St. Charles et al. | 131/194 |
| 2002/0100487 | A1 | * | 8/2002 | St. Charles et al. | 131/185 |

FOREIGN PATENT DOCUMENTS

| | | | | |
|---|---|---|---|---|
| SU | 1588993 | A * | 8/1990 | F23D/14/62 |

* cited by examiner

*Primary Examiner*—Ira S. Lazarus
*Assistant Examiner*—James G. Barrow
(74) *Attorney, Agent, or Firm*—John F. Salazar; Steven A. Witters; Middleton Reutlinger

(57) ABSTRACT

A micro gas burner is provided that generates a stable, pre-mixed flame that produces little to no soot or unburned hydrocarbons. The gas burner includes a fuel inlet, nozzle, oxygenation chamber with at least one air inlet, a mixing chamber having a frustoconical inner wall, at least one permeable barrier and a flame holder. The gas burner thoroughly mixes fuel and entrained air to form a nearly stoichiometric mixture prior to combustion. The gas burner mixes the fuel and air so thoroughly that it requires a lower fuel flow rate than would otherwise be necessary to produce a stable, pre-mixed flame. The gas burner may include an optional flame tube in which a flame is contained and sequestered from diffusing air.

31 Claims, 5 Drawing Sheets

GAS MICRO BURNER

BACKGROUND OF THE INVENTION

1. Field of the Invention

This invention relates generally to gas combustion burners. More particularly, the present invention relates to an integral gas burner for a smoking article employing combustion for a pre-mixed gaseous fuel.

2. Description of the Related Art

Small scale gas combustion burners, such as those used in cigarette lighters, are well known in the art. Most cigarette lighters use buoyancy to entrain air for diffusion combustion. The fuel vapors and air meet at the point of ignition and burn instantaneously. Hence, the fuel and air are not mixed upstream from the point of ignition in such lighters. Since no apparatus for pre-mixing is necessary, a diffusion flame lighter may be quite short in length. Unfortunately, diffusion flame burners tend to produce soot from unburned hydrocarbons and pyrrolitic products that occur due to incomplete combustion of the gaseous fuel. Furthermore, flames produced by diffusion burners tend to be unstable and bend as the burner is rotated.

The production of a pre-mixed flame in a gas combustion burner is also well known in the art. A pre-mixed flame is the product of a combustion process wherein the fuel is mixed with air upstream of the point of ignition. By the time the fuel/air mixture reaches the point of ignition, a stoichiometrically sufficient amount of oxygen is available for the combustion reaction to proceed to near completion. The flame produced by the pre-mixing of the fuel and air is stable and will not bend if the burner is rotated. Furthermore, since the fuel/air mixture tends to combust completely, a pre-mixing gas burner produces little to no soot or unreacted hydrocarbons. The stoichiometric or oxygen-rich flame produced in such a gas burner leaves predominantly $CO_2$, $H_2O$ and $N_2$ as the only combustion byproducts.

In the production of a pre-mixed flame, the mixing of the fuel and air prior to combustion is usually performed with a venturi, which draws air into the burner as fuel passes therethrough. However, the presence of an effective venturi tends to add to the overall length of the burner apparatus. In addition, the fuel mass flow rate requirement of the burner affects the overall size of the combination of the burner and fuel storage container. For example, the smallest fuel flow rate for a butane lighter that sustains a stable pre-mixed flame approaches approximately 0.71 mg/s. Reducing the fuel mass flow rate requirement thereby allows for a reduction in the overall size of the burner and fuel storage container. Reducing the size of the burner and fuel tank expands the scope of possible applications of such a burner.

It is, therefore, desirable to provide a gas burner that produces a stable pre-mixed flame and that is small enough to be used in a variety of applications, such as smoking articles.

SUMMARY OF THE INVENTION

It is an object of the present invention to provide a gas burner that generates a stable pre-mixed flame with low fuel mass flow rate requirements.

It is another object of the present invention to provide a gas burner that may be used for a smoking article and that also may be sized smaller than conventional gas lighters.

It is a further object of the present invention to provide a mixing chamber for a gas burner that provides highly efficient mixing of fuel and air in a small volume.

More particularly, the present invention is directed to a burner assembly for combustion of gaseous fuel. The burner assembly includes a fuel inlet, nozzle, an oxygenation chamber with at least one air inlet, a mixing chamber, at least one permeable barrier, a flame holder, an optional flame tube, and an optional burner housing. The fuel inlet connects the burner assembly to the gaseous fuel storage tank. An optional flow adjustment mechanism may be attached to the fuel inlet to regulate the fuel mass flow rate from a fuel storage container. The nozzle is in flow communication with the fuel inlet and affects both the static pressure and the velocity of the fuel stream passing therethrough. The nozzle feeds fuel from the fuel inlet to the oxygenation chamber. The inner diameter of the nozzle is significantly smaller than that of the fuel inlet, thereby accelerating the fuel stream passing therethrough. The static pressure of the fuel stream drops as it travels from the constricted nozzle into the larger oxygenation chamber. At least one air inlet is disposed in one or more of the walls of the oxygenation chamber. Air is drawn into the oxygenation chamber through the air inlet(s) by the reduction in static pressure caused by the gaseous fuel entering the oxygenation chamber through the nozzle. The size of the nozzle influences the mass flow rate of air drawn into the venturi tube through the air inlets.

A mixing chamber is in flow communication with the oxygenation chamber. The mixing chamber provides for the efficient mixing of the air and the gaseous fuel in a relatively small volume. The mixing chamber has either an inner wall which includes a frustoconical section, or a ferrule may be disposed within the mixing chamber to provide an inner wall with a frustoconical section. In either case, the interior of the mixing chamber expands from the proximal end, which is adjacent to the oxygenation chamber, to the distal end. The diverging side wall of the mixing chamber provides an interior space in which the fuel and air may efficiently mix. At least one permeable barrier is disposed downstream of and in flow communication with the mixing chamber. The permeable barrier may be disposed at the outlet of the mixing chamber to be spaced therefrom. The permeable barrier may be a porous metal or ceramic plate, or another permeable material or structure that inhibits the flow of the fuel/air mixture from the mixing chamber. The permeable barrier restricts the flow of the fuel/air mixture and causes a drop in the mixture's static pressure. The result of the flow restriction is recirculation of a portion of the fuel/air stream within the mixing chamber. Recirculation eddies tend to form within the mixing chamber around the axis of the flow stream. This recirculation provides for a more complete mixing of the fuel/air stream prior to ignition.

A flame holder is disposed in the gas burner downstream of and in flow communication with the permeable barrier(s). The flame holder includes at least one opening therein which further restricts the fuel/air stream flow. An ignition means is disposed downstream of the flame holder and precipitates the combustion of the fuel/air stream upon activation. The flame holder prevents the flame generated by the combustion of the fuel/air stream from flashing back through the burner. An optional flame tube may also be provided. The flame tube localizes the flame and prevents diffusion of air to it. The flame generated by the burner is a stable pre-mixed flame that has at least a stoichiometrically sufficient amount of air for complete combustion of the fuel.

The flame generated within the gas burner will not bend and is, thus, unaffected by the orientation of the burner. Furthermore, the combustion process carried out in the burner does not require diffused air to assist in complete reaction; therefore, the flame may be enclosed within a flame tube. Enclosing the flame allows the gas burner to be employed in a variety of applications, such as an integral cigarette lighter, in which other flames, which rely on diffusing air, would be inappropriate. The burner generates a stable, pre-mixed flame with a significantly smaller fuel flow rate than required by conventional cigarette lighters. For example, conventional butane lighters generally required fuel mass flow rates of at least 0.71 mg/s, whereas the gas burner of the present invention produces a sustainable pre-mixed flame with a fuel flow rate in the range of approximately 0.14 mg/s–0.28 mg/s. At this specified range, a lighter utilizing the gas burner of the present invention generates a heat output of approximately 6–12 Watts. Such power output allows such a gas burner to be used in an integral lighter for a smoking article.

It will become apparent that other objects and advantages of the present invention will be obvious to those skilled in the art upon reading the detailed description of the preferred embodiment set forth hereinafter.

DESCRIPTION OF THE PREFERRED EMBODIMENT

Figure 1:
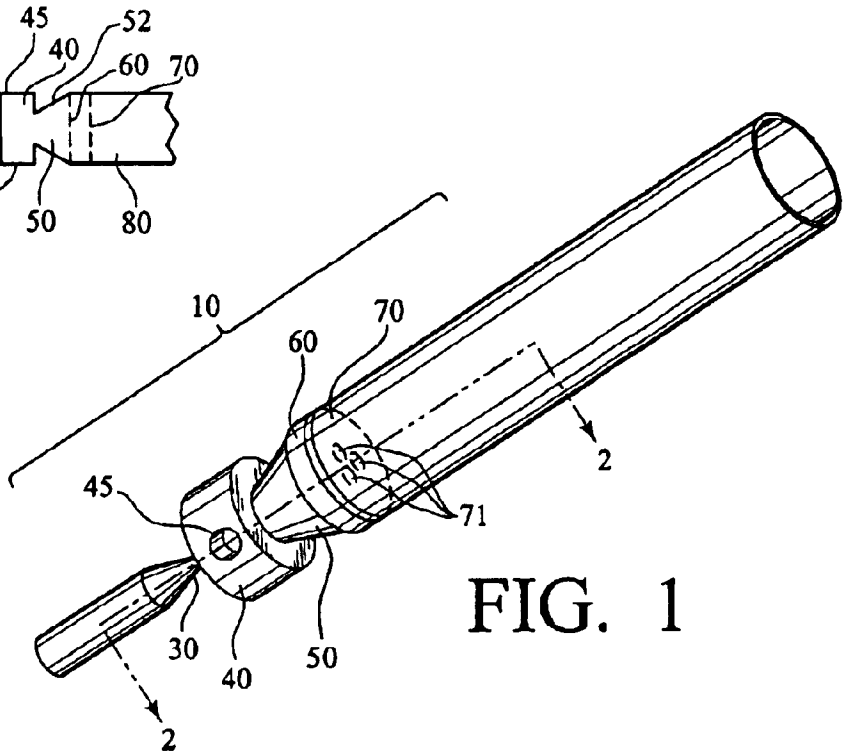
FIG. 1 is a perspective view of the gas burner of the present invention with selected portions shown in phantom lines.
Figure 2:
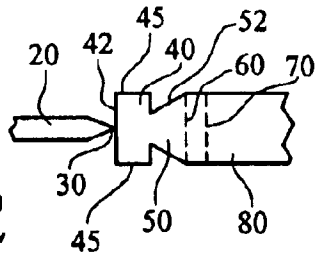
FIG. 2 is a cross-sectional view of the gas burner taken along line 2—2 of FIG. 1.
Figure 5:
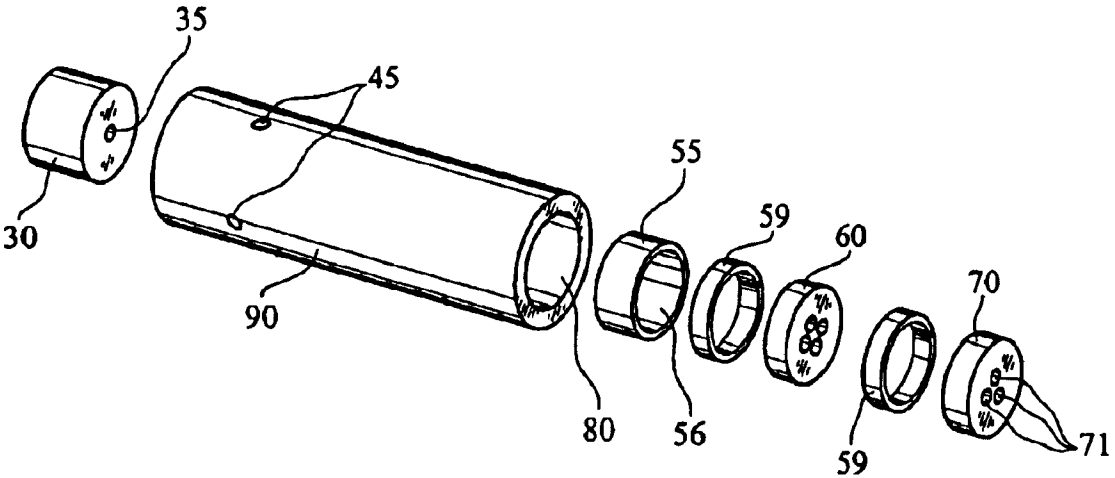
FIG. 5 is an exploded view of yet another embodiment of the gas burner of the present invention.
Figure 7:
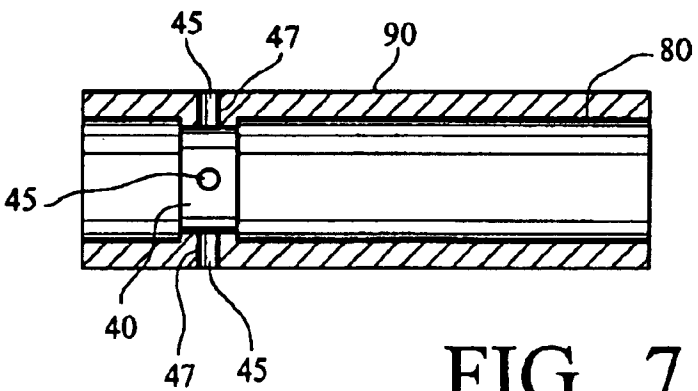
FIG. 7 is a cross-sectional view of the burner housing of FIG. 6 taken along line 7—7.
Figure 6:
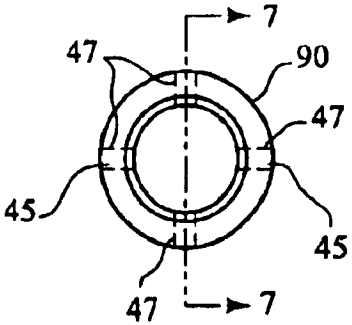
FIG. 6 is an end on view of the burner housing of the gas burner of FIG. 5.
Figure 8:
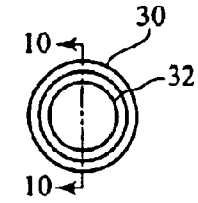
FIG. 8 is an end on view of the nozzle of the gas burner of FIG. 5.
Figure 9:
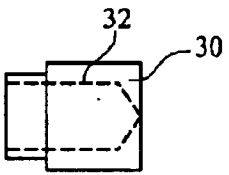
FIG. 9 is a side view of the nozzle of FIG. 8 with selected portions shown in phantom lines.
Figure 10:
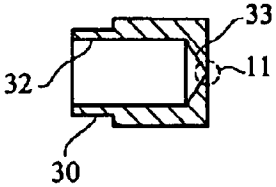
FIG. 10 is a cross-sectional view of the nozzle of FIG. 8 taken along lines 10—10.

As shown in FIGS. 1 and 2, air inlet(s) 45 are open to ambient and allow air to be drawn into the oxygenation chamber 40. At least one air inlet 45 is in flow communication with oxygenation chamber 40. In two preferred embodiments, as shown in FIGS. 5–7 and FIGS. 24–26, the gas burner 10 may have four or more air inlets 45 conducting air from ambient to the oxygenation chamber 40. Additionally, air inlet 45 may have any appropriate configuration. For example, air inlet 45 may have a cylindrical sidewall 47 extending through the sidewall 41 of oxygenation chamber 40, as shown in FIGS. 5–7. As an alternative to air inlet 45, an air inlet may be disposed concentrically with orifice 35 within proximal wall 42 of oxygenation chamber 40. The nozzle 30 and oxygenation chamber 40 cooperate to form a high-efficiency venturi. The pressurized flow of fuel through the nozzle 30 and orifice 35 into the oxygenation chamber 40 causes a reduction in the static pressure of the flow within the oxygenation chamber 40. This reduction of the static pressure draws air through the air inlet 45 into the oxygenation chamber 40. In a preferred embodiment, the oxygenation chamber 40 is approximately 3–4 mm in length.

Figure 12:
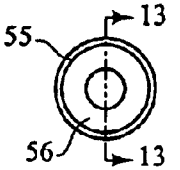
FIG. 12 is an end view of the ferrule of the gas burner of FIG. 5.
Figure 13:
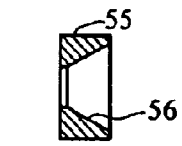
FIG. 13 is a cross sectional view of the ferrule of FIG. 12 taken along line 13—13.
Figure 14:
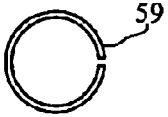
FIG. 14 is an end view of a shim of the gas burner of FIG. 5.
Figure 15:
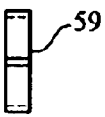
FIG. 15 is a side view of the shim of FIG. 14.

The oxygenation chamber 40 is in flow communication with the mixing chamber 50. The fuel and entrained air flow from the oxygenation chamber into the mixing chamber 50. The mixing chamber 50 may have an inner side wall 51 at least a portion 52 of which is frustoconical. Alternatively, as shown in FIGS. 5, 12 and 13, a mixing ferrule 55 having a frustoconical inner wall 56 may be included in the gas burner 10 and serve as the mixing chamber. In a preferred embodiment, the frustoconical portion 52 of the mixing chamber 50 is approximately 2–4 mm in length.

The oxygenation chamber 45 is in flow communication with the mixing chamber 50. The fuel and entrained air flow from the oxygenation chamber into the mixing chamber 50. The mixing chamber 50 may have an inner side wall 51 at least a portion 52 of which is frustoconical. Alternatively, as shown in FIGS. 5, 12 and 13, a mixing ferrule 55 having a frustoconical inner wall 56 may be included in the gas burner 10 and serve as the mixing chamber. In a preferred embodiment, the frustoconical portion 52 of the mixing chamber 50 is approximately 2–4 mm in length.

As shown in FIG. 2, at least one permeable barrier 60 is in flow communication with the mixing chamber 50. The permeable barrier 60 is preferably disposed downstream from the mixing chamber 40, as shown in FIGS. 1–4. The presence of the permeable barrier 60 creates a pressure differential on either side thereof, the higher static pressure being upstream of the permeable barrier 60 and the lower pressure being downstream therefrom. The pressure differential thereby provides for the formation of recirculation eddies within the fuel/air stream to either side of the axis of the mixing chamber. The mixing of the air and the fuel occurs on the molecular level and proceeds to near complete mixing before the fuel/air mixture leaves the mixing chamber 50.

Figure 16:
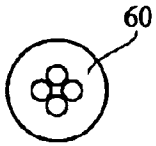
FIG. 16 is a front view of the permeable barrier of the gas burner of FIG. 5 with selected portions shown in phantom lines.
Figure 17:
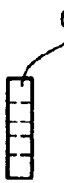
FIG. 17 is a side view of the permeable barrier of FIG. 16.
Figure 18:
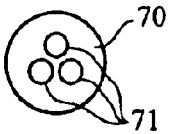
FIG. 18 is a front view of the flame holder of the gas burner of FIG. 5.
Figure 19:
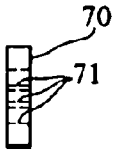
FIG. 19 is a side view of the flame holder of FIG. 18 with selected portions shown in phantom lines.
Figure 19B:
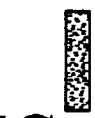
FIG. 19*b* is a side view of the permeable barrier of FIG. 19*a*.
Figure 20:
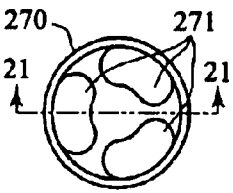
FIG. 20 is a front view of another embodiment of the flame holder of the gas burner of FIG. 5.
Figure 21:
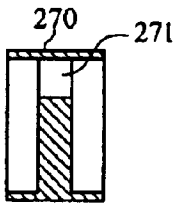
FIG. 21 is a cross-sectional view of the flame holder of FIG. 20 taken along line 21—21.
Figure 19A:
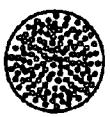
FIG. 19*a* is a front view of another embodiment of the permeable barrier of the gas burner of the present invention.
Figure 24:
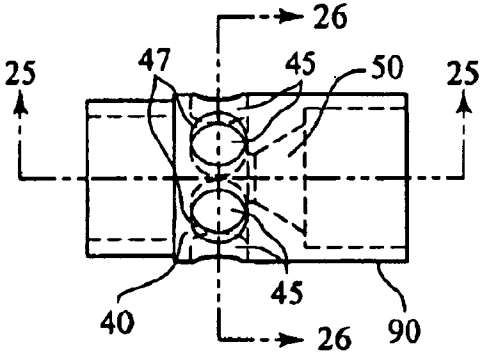
FIG. 24 is a side view of another embodiment of the burner housing of the gas burner of the present invention with selected portions shown in phantom lines.
Figure 25:
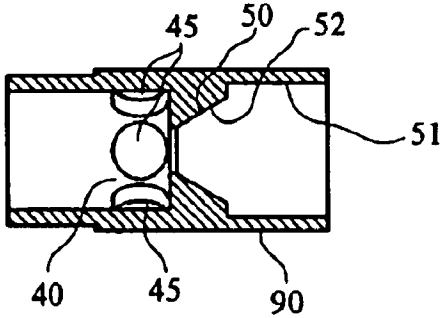
FIG. 25 is a cross-sectional view of the burner housing of FIG. 24 taken along lines 25—25.
Figure 26:
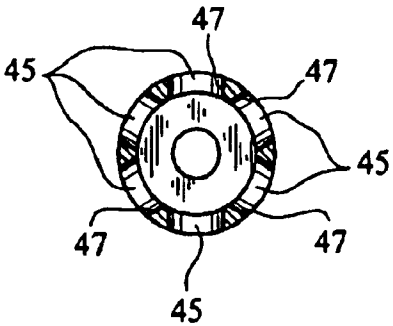
FIG. 26 is another cross-sectional view of the burner housing of FIG. 24 taken along lines 26—26.
Figure 22:
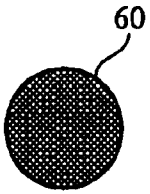
FIG. 22 is a front view of another embodiment of the permeable barrier of the gas burner of the present invention.
Figure 23:
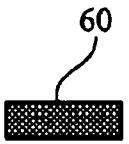
FIG. 23 is a side view of the permeable barrier of FIG. 22.

The permeable barrier 60 may be formed of a variety of materials and have a variety of configurations. The permeable barrier 60 may include a wire mesh formed of a metallic or polymeric material, as shown in FIGS. 22–23. For example, in a preferred embodiment, a wire mesh formed of nickel wire having a diameter of 0.114 mm was included in the permeable barrier. Other metals from which the wire mesh may be formed include brass and steel. Alternatively, the permeable barrier 60 may be a porous plate formed of metallic or ceramic material. A porous plate may have a few large holes, as shown in FIGS. 5, 16 and 17, or many smaller holes, as shown in FIGS. 19*a* and 19*b*. Regardless of the configuration and the materials of construction of the permeable barrier 60, the fuel/air mixture travels through the permeable barrier 60. The permeable barrier 60 provides for further mixing of the gaseous fuel and air as they pass therethrough. The drop in static pressure experienced by the fuel/air mixture as it travels through the permeable barrier 60 serves to decelerate the mixture flow so that the flame produced downstream will not lift off from the flame holder 70, shown in FIGS. 1, 5, 18 and 19.

The pressure differential created by the permeable barrier 60 adversely affects the rate of entrainment of air within the burner 10. More particularly, as the pressure drop caused by the permeable barrier 60 increases, the flow rate of air entrained by the venturi decreases, thereby producing a fuel/air mixture that tends to be more fuel-rich. As a result, the porosity of the permeable barrier 60 must be taken into account in selecting a barrier that provides an appropriate fuel and air ratio. The goal of mixing the fuel and the air prior to ignition is to attain a mixture ratio of fuel to air that approaches a stoichiometric ratio, or that is slightly oxygen-rich. The result of a stoichiometrically balanced mixture of fuel and air is that the mixture will proceed to nearly complete combustion upon ignition, thereby producing a stable flame without soot or unburned hydrocarbons. Therefore, the porosity or void fraction of the permeable barrier 60 should be such that, when combined with a nozzle 30 of a particular size, the permeable barrier 60 provides a mass flow rate of air entrained within the oxygenation chamber 40 that leads to a near stoichiometric ratio between the gaseous fuel and air.

The porosity is the percentage of open area present within the permeable barrier. The porosity represents the available area through which the fuel/air mixture may flow from the mixing chamber 50. In a preferred embodiment, the permeable barrier has a porosity of approximately 35% to 40% for a 30 micron diameter nozzle 30, in order to achieve a fuel to air ratio that is stoichiometric or slightly oxygen-rich. The preferred porosity of the permeable barrier 60 varies with the diameter of the nozzle 30.

Figure 4:
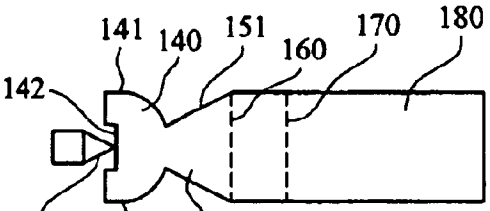
FIG. 4 is a cross-sectional view of another embodiment of the gas burner of the present invention.
Figure 11:
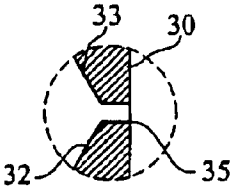
FIG. 11 is an expanded view of area 10 of the nozzle of FIG. 10.

The diameter of nozzle 30 also affects the entrainment of air within the oxygenation chamber 40. The pressure drop of the fuel flow increases as the diameter of the nozzle diameter decreases. In a preferred embodiment, the diameter of the nozzle 30 is within the range of 30 to 60 microns. However, the present invention contemplates nozzle diameters outside of this given range. For nozzles with diameter approaching 50 microns and greater, an alternative embodiment of the oxygenation chamber 140 of the present invention is shown in FIG. 4. Oxygenation chamber 140 has a spherical side wall 141 and a recessed portion in proximal wall 142 in which is disposed an orifice, similar to orifice 35 shown in FIG. 11, into which nozzle 130 opens. Air inlet(s) 145 may be disposed within spherical side wall 141 and/or in proximal wall 142. Oxygenation chamber 140 is in flow communication with both nozzle 130 and mixing chamber 150, which has a frustoconical side wall 151. The flame holder 170 is in flow communication with the screen 160 and flame tube 180.

Figure 3:
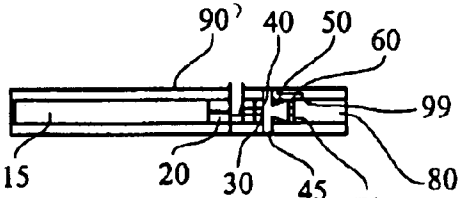
FIG. 3 is a cross-sectional view of the gas burner of the present invention attached to a fuel storage container and enclosed in a burner housing.

As shown in FIG. 3, the gas burner 10 may include an ignition source 99 positioned downstream of the flame holder 70. The ignition source 99 may be any source known in the art, such as a piezoelectric element, electrical or flint ignitor.

As shown in FIGS. 1–5, the gas burner 10 may also include a flame tube 80 or 180 in which a pre-mixed flame may be contained. The flame tube 80 prevents diffusion of air to the pre-mixed flame. The flame tube 80 may be formed of any metallic, ceramic or polymeric material that may withstand the temperatures produced by the combustion process that occurs in gas burner 10. The flame produced within the gas burner 10 is disposed substantially within the flame tube 80

The gas burner 10 may be housed within a burner housing 90, as shown in FIGS. 3, and 5. The burner housing 90 may enclose some or all of the fuel inlet 20, nozzle 30, oxygenation chamber 40, mixing chamber 50, permeable barrier 60, flame holder 70 and flame tube 80, as well as a gaseous fuel storage cartridge. The burner housing 90 may be formed of metallic, ceramic or polymeric material.

As shown in FIGS. 5–19, the gas burner 10 may be provided in an assembly. FIG. 5 shows an exploded view of one embodiment of the gas burner 10. In this embodiment, nozzle 30, ferrule 55, permeable barrier 60 and flame holder 70 are disposed in a burner housing 90. In this embodiment, burner housing 90 includes oxygenation chamber 40, air inlets 45 and flame tube 80 integrally formed therein. Shims 59 are disposed between ferrule 55, permeable barrier 60 and flame holder 70. Shims 59 provide adequate spacing between these components.

Figure 1A:
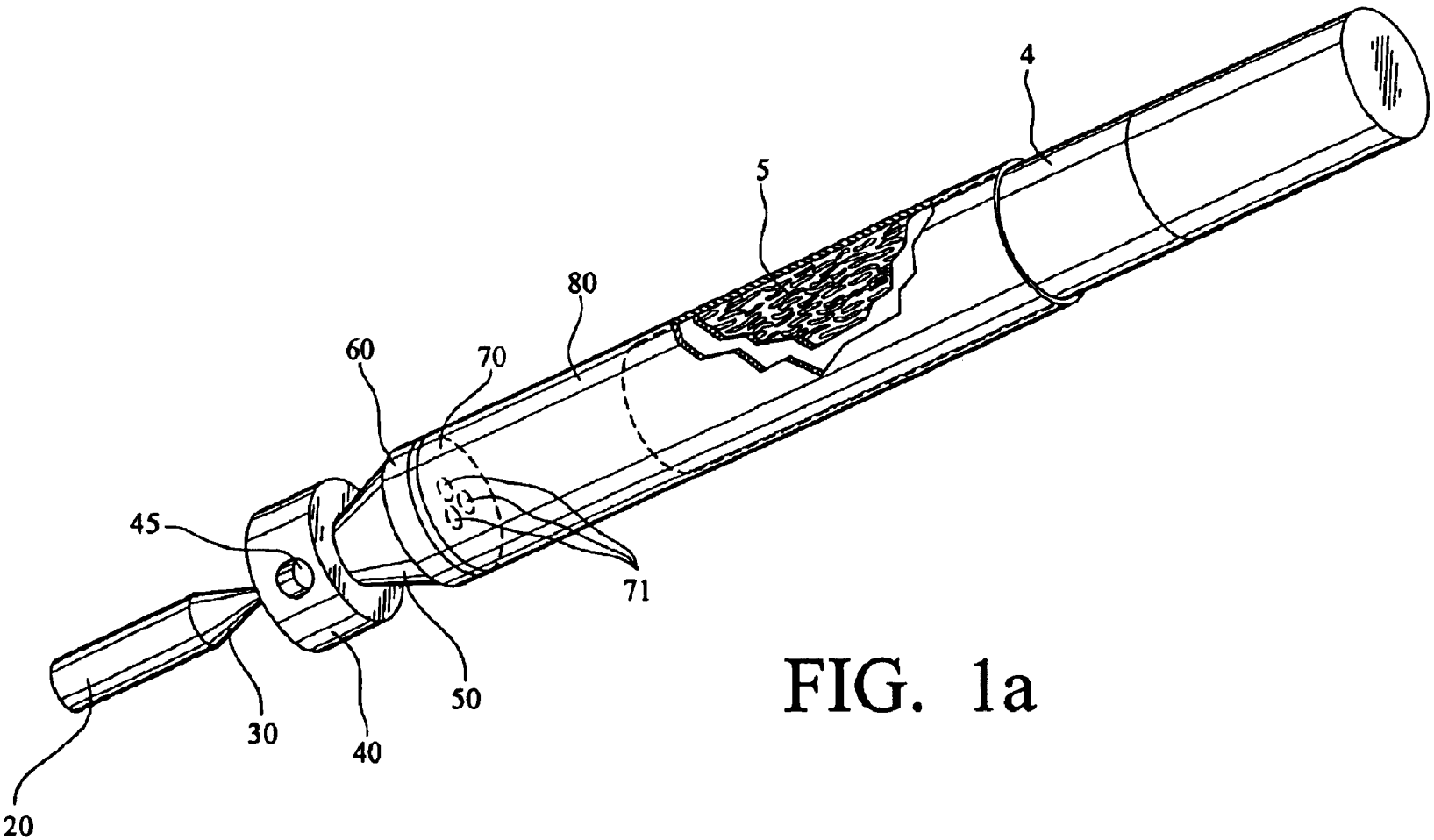
FIG. 1*a* is a perspective view of the gas burner of FIG. 1 with a cigarette inserted therein and with selected portions shown in phantom lines and other selected portions in cutaway.

The gas burner 10 of the present invention provides for such efficient mixing of low molecular weight hydrocarbon fuels, such as butane, with air that the length of the gas burner 10 may be approximately 50% shorter than the length of a commercially available butane burner that produces a pre-mixed flame. As a result, the gas burner 10 of the present invention may be disposed in a smoking article in which a smokable material is burned by an integral lighter included therein. FIG. 1*a* shows the gas burner 10 with a cigarette 4 disposed in flame tube 80. Cigarette 4 may include tobacco 5 or any other aerosol-generating smokable material well known in the art. The size of such a smoking article, including the gas burner 10, may approach the size of a conventional cigarette.

The foregoing detailed description of the preferred embodiments of the present invention are given primarily for clearness of understanding and no unnecessary limitations are to be understood therefrom for modifications will become obvious to those skilled in the art upon reading the disclosure and may be made without departing from the spirit of the invention and scope of the appended claims.

What is claimed is:

1. A gas burner comprising:

a nozzle;

an oxygenation chamber in flow communication with said nozzle;

at least one air inlet in flow communication with said oxygenation chamber;

a mixing chamber in flow communication with said oxygenation chamber, said mixing chamber having a frustoconical inner wall; and a flame holder in flow communication with said mixing chamber, said flame holder having at least one opening therein.

2. The gas burner of claim 1, said at least one air inlet being open to ambient.

3. The gas burner of claim 1, wherein said nozzle includes an orifice opening into said oxygenated chamber.

4. A gas burner comprising:

a venturi having a nozzle and an oxygenation chamber in flow communication with said nozzle, said oxygenation chamber having at least one air inlet;

a mixing chamber in flow communication with said oxygenation chamber and having a frustoconical portion of an inner wall that diverges from said oxygenation chamber;

at least one permeable barrier in flow communication with said mixing chamber and being disposed opposite said oxygenation chamber; and a flame holder in flow communication with said permeable barrier.

5. The gas burner of claim 4, said at least one air inlet being open to ambient.

6. The gas burner of claim 4, said at least one air inlet disposed in a side wall of said oxygenation chamber.

7. The gas burner of claim 4, wherein said nozzle includes an orifice opening into said oxygenation chamber.

8. The gas burner of claim 4, said mixing chamber including a ferrule disposed therein.

9. The gas burner of claim 4, said at least one permeable barrier being formed of a ceramic.

10. The gas burner of claim 4, said at least one permeable barrier having a porosity of approximately 35% to 40%.

11. The gas burner of claim 4, said nozzle having an inner diameter of about 30 to 60 microns.

12. The gas burner of claim 4, said mixing chamber being about 3 mm to 4 mm in length.

13. The gas burner of claim 4, wherein said oxygenation chamber has a spherical side wall.

14. The gas burner of claim 13, said oxygenation chamber including a proximal wall having a recessed portion therein.

15. The gas burner of claim 4, including a burner housing.

16. The gas burner of claim 15, said mixing chamber, said permeable barrier and said flame holder being disposed within said burner housing.

17. The gas burner of claim 4, including an ignition means in flow communication with said flame holder.

18. The gas burner of claim 17, said ignition means being a piezoelectric igniter.

19. The gas burner of claim 4, including a flame tube in flow communication with said flame holder.

20. The gas burner of claim 19, said flame tube being formed of a ceramic material.

21. The gas burner of claim 4, said at least one permeable barrier including a wire mesh.

22. The gas burner of claim 21, said wire mesh being formed of a metal.

23. The gas burner of claim 22, wherein said metal is selected from the group consisting of nickel, brass, and steel.

24. The gas burner of claim 4, including a fuel inlet being in flow communication with a fuel storage container.

25. The gas burner of claim 24, said fuel storage container containing a gaseous fuel.

26. The gas burner of claim 25, said a gaseous fuel including a low molecular weight hydrocarbon.

27. The gas burner of claim 25, wherein said low molecular weight hydrocarbon is selected from the group consisting of methane, ethane, propane, butane, and acetylene.

28. The gas burner of claim 4, said flame holder having three openings therein.

29. The gas burner of claim 28, wherein each of said three openings are kidney-shaped.

30. The gas burner of claim 28, wherein each of said three openings are substantially circular.

31. The gas burner of claim 30, said three openings being spaced 120° apart around a center of said flame holder.

* * * * *